US010292552B2

(12) United States Patent
Lim et al.

(10) Patent No.: US 10,292,552 B2
(45) Date of Patent: May 21, 2019

(54) VACUUM CLEANER

(71) Applicant: Samsung Electronics Co., Ltd., Suwon-si (KR)

(72) Inventors: Tae Woon Lim, Suwon-si (KR); Dong Hun Yoo, Suwon-si (KR); Hyoun Soo Kim, Suwon-si (KR); Seok Bong Baek, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 127 days.

(21) Appl. No.: 15/255,382

(22) Filed: Sep. 2, 2016

(65) Prior Publication Data

US 2017/0055791 A1 Mar. 2, 2017

(30) Foreign Application Priority Data

Sep. 2, 2015 (KR) ..... 10-2015-0123979

(51) Int. Cl.

| | |
|---|---|
| ***A47L 7/00*** | (2006.01) |
| ***A47L 9/06*** | (2006.01) |
| ***A47L 9/04*** | (2006.01) |

(52) U.S. Cl.

CPC ..... *A47L 7/0066* (2013.01); *A47L 9/0477* (2013.01); *A47L 9/0673* (2013.01)

(58) Field of Classification Search

CPC ..... A47L 7/0066; A47L 9/0477; A47L 9/0673
See application file for complete search history.

(56) References Cited

U.S. PATENT DOCUMENTS

| | | | | |
|---|---|---|---|---|
| 4,890,869 | A * | 1/1990 | Langkamp, Jr. | E05C 19/14 292/103 |
| 5,271,649 | A * | 12/1993 | Gromotka | E05C 19/14 292/113 |
| 6,041,721 | A * | 3/2000 | Weston | E05C 19/14 108/64 |
| 2005/0138765 | A1* | 6/2005 | Lee | A47L 9/0455 15/392 |
| 2009/0133211 | A1* | 5/2009 | Ashbee | A47L 9/0411 15/300.1 |

(Continued)

FOREIGN PATENT DOCUMENTS

| | | | | |
|---|---|---|---|---|
| JP | 2008-259718 | A | 10/2008 | |
| JP | WO 2011158596 | A1 * | 12/2011 | A47L 9/0416 |

(Continued)

OTHER PUBLICATIONS

WO 2011158596 A1—English Machine Translation.*
JP 2013022228 A—English Machine Translation.*
BASF—Snap-Fit Design Manual Oct. 24, 2007.*

*Primary Examiner* — Marc Carlson
(74) *Attorney, Agent, or Firm* — Staas & Halsey LLP

(57) ABSTRACT

Disclosed herein is a vacuum cleaner having an improved structure capable of removing hair and foreign substances wound around a drum brush. The vacuum cleaner includes a cleaner main body, a suction brush connected to the cleaner main body and including a suction channel configured to clean a surface to be cleaned by suction force, and a drum brush case provided to be detachable in a forward direction from the suction brush and configured to form an intake port connected to the suction channel.

15 Claims, 12 Drawing Sheets

(56) References Cited

U.S. PATENT DOCUMENTS

| | | | | |
|---|---|---|---|---|
| 2012/0011680 | A1* | 1/2012 | Owen | A47L 9/04 15/383 |
| 2014/0053351 | A1* | 2/2014 | Kapoor | A47L 9/106 15/52.1 |
| 2015/0359396 | A1* | 12/2015 | Yun | A47L 9/0477 15/347 |
| 2016/0220083 | A1* | 8/2016 | Thorne | A47L 5/30 |
| 2016/0220084 | A1* | 8/2016 | Xu | A47L 9/04 |
| 2017/0027398 | A1* | 2/2017 | Andrews | A47L 9/0411 |

FOREIGN PATENT DOCUMENTS

| | | | | |
|---|---|---|---|---|
| JP | 2013-022228 | A | | 2/2013 |
| JP | 2013022228 | A | * | 2/2013 |
| KR | 10-2011-0125941 | A | | 11/2011 |
| WO | 11158596 | A1 | | 12/2011 |

* cited by examiner

VACUUM CLEANER

CROSS-REFERENCE TO RELATED APPLICATION

This application claims the benefit of Korean Patent Application No. 10-2015-0123979, filed on Sep. 2, 2015 in the Korean Intellectual Property Office, the disclosure of which is incorporated herein by reference.

BACKGROUND

1. Field

Embodiments of the present disclosure relate to a vacuum cleaner, and more particularly, to a vacuum cleaner having an improved structure capable of removing hair and foreign substances wound around a drum brush.

2. Description of the Related Art

As cleaner is an apparatus that cleans by removing foreign substances indoors, a vacuum cleaner is normally used at home. A vacuum cleaner is an apparatus which suctions air including foreign substances of a surface to be cleaned, separates and collects the foreign substances from the air, and discharges purified air to the outside of the vacuum cleaner main body.

Such a vacuum cleaner is roughly classified as a canister type or an upright type.

Of the two, a canister cleaner includes a main body in which a blowing fan and a dust collector are embedded, a suction body separately installed from the main body to suction dust on a floor, and a connection pipe which connects the main body and the suction body. Therefore, a user grabs a handle installed at the connection pipe and moves the suction body in an intended direction for cleaning.

In contrast, an upright cleaner includes a main body of an upright type and a suction body integrally coupled to a lower portion of the main body. Therefore, a user grabs a handle provided at an upper side of the main body and moves the entire main body of the upright cleaner for cleaning.

Particularly, in the upright cleaner, a drum brush is installed inside the suction body to enhance cleaning efficiency. Such a drum brush rotates at a high speed while being in contact with a surface to be cleaned and separates foreign substances from the surface to be cleaned, and the separated foreign substances are suctioned into the suction body and then introduced into a dust collector provided in the main body.

Meanwhile, some of the foreign substances suctioned into the suction body at high speed are wound around and adhered to the drum brush due to rotational force of the rotating drum brush and then rotate together with the drum brush, which can cause degradation in cleaning efficiency.

SUMMARY

Therefore, it is an aspect of the present disclosure to provide a vacuum cleaner having an improved structure capable of removing hair and foreign substances wound around a drum brush.

In accordance with one aspect of the present disclosure, a vacuum cleaner includes a cleaner main body, a suction brush connected to the cleaner main body and including a suction channel configured to clean a surface to be cleaned by suction force, and a drum brush case provided to be detachable in a forward direction from the suction brush and configured to form an intake port connected to the suction channel.

The drum brush case may include a drum brush rotatably provided therein.

The vacuum cleaner may further include a connection member which detachably connects the drum brush case and the suction brush.

The drum brush case may include a case frame and a case cover coupled to the case frame and configured to form an accommodating space in which the drum brush is accommodated.

The drum brush case may include a guide portion which guides separation from or coupling to the suction brush.

The guide portion may include a guide protrusion formed at the drum brush case and a guide groove formed at the suction brush so that the guide protrusion is inserted therein.

The connection member may include a first connection portion provided at the drum brush case and a second connection portion provided at the suction brush so that the first connection portion is coupled thereto.

The first connection portion may include a connection bracket in which a support portion is formed to rotatably support the drum brush and a button member elastically supported by the connection bracket.

The vacuum cleaner may further include an elastic member which provides a support between the connection bracket and the button member elastically.

The second connection portion may include any one of a hole and a slit to which the button member is connected.

The support portion may include a support hole in which the drum brush is rotatably supported, at least one support protrusion formed to be spaced in a circumferential direction of the support hole, and a bearing provided between the support hole and the support protrusion so that the drum brush is rotatably connected.

The case cover may include a drum brush installation portion formed so that the drum brush is detachable, and at least one remover protrusion formed to be spaced in a circumferential direction of the drum brush installation portion.

The remover protrusion may be formed to protrude radially inward of the drum brush installation portion.

The remover protrusion may be slanted radially inward of the drum brush installation portion.

The suction brush may include a driving part provided to rotate the drum brush.

The connection bracket may be bent from and coupled to an end of one side of the drum brush for a user to grab.

In accordance with another aspect of the present disclosure, a vacuum cleaner includes a cleaner main body, a suction brush connected to the cleaner main body to suction dust on the surface to be cleaned, a drum brush case detachably coupled to a front of the suction brush and including a drum brush which is rotatably provided therein, and a connection member which detachably connects the drum brush case and the suction brush.

The connection member may include a first connection portion provided at the drum brush case, and a second connection portion formed at the suction brush to correspond to the first connection portion.

The first connection portion may include a connection bracket in which a support portion is formed to support the drum brush; and a button member which is elastically supported by the connection bracket.

The support portion may include a support hole provided so that the drum brush is rotatably supported, at least one support protrusion formed to be spaced each other in a circumferential direction of the support hole, and a bearing provided between the support hole and the support protrusion so that the drum brush is rotatably connected.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, a preferred embodiment according to the present disclosure will be described in detail with reference to the accompanying drawings. Meanwhile, terms used in the following descriptions such as "front," "rear," "upper," "lower," "top," "bottom," and the like are defined based on the drawings, and shapes and positions of each constituting element are not limited by these terms.

Figure 1:
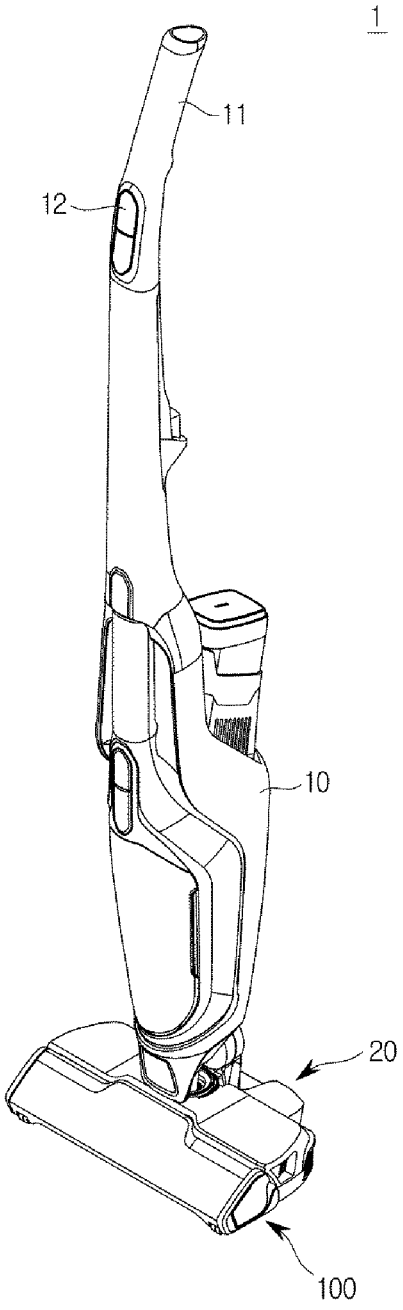
FIG. 1 is a perspective view illustrating a vacuum cleaner according to one embodiment of the present disclosure.
Figure 2:
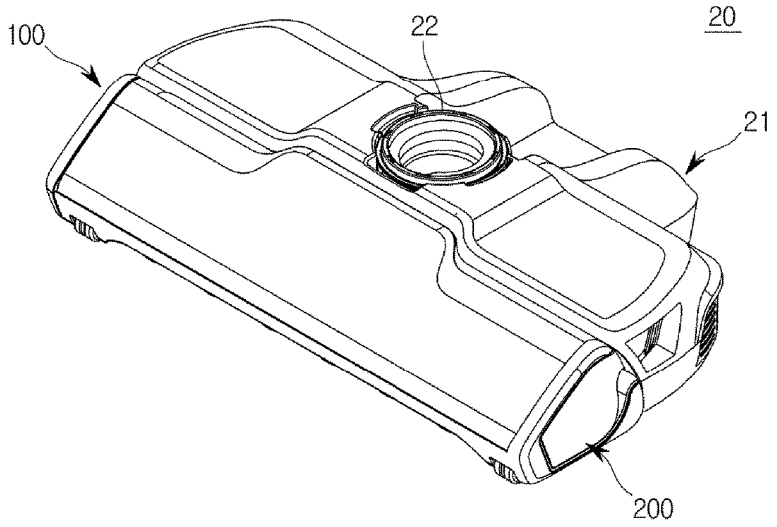
FIG. 2 is a view illustrating a suction brush of a vacuum cleaner according to one embodiment of the present disclosure.
Figure 3:
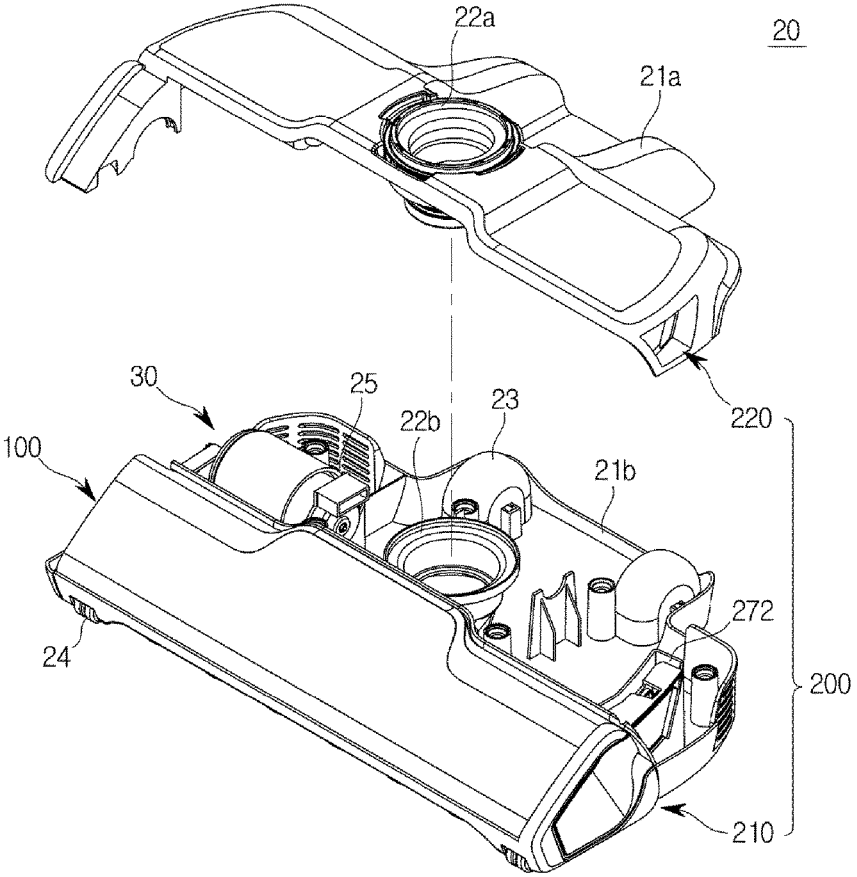
FIG. 3 is an exploded perspective view illustrating a suction brush of a vacuum cleaner according to one embodiment of the present disclosure.

FIG. 1 is a perspective view illustrating a vacuum cleaner according to one embodiment of the present disclosure, FIG. 2 is a view illustrating a suction brush of a vacuum cleaner according to one embodiment of the present disclosure, and FIG. 3 is an exploded perspective view illustrating a suction brush of a vacuum cleaner according to one embodiment of the present disclosure.

As illustrated in FIGS. 1 to 3, a vacuum cleaner 1 is an upright type vacuum cleaner and includes a suction brush 20 provided to suction foreign substances including hair, etc. of a surface to be cleaned (a floor and a carpet) by air suction force and a cleaner main body 10 provided to collect foreign substances suctioned via the suction brush 20.

The cleaner main body 10 may include a motor (not shown) which generates a suction force required for suctioning foreign substances of a surface to be cleaned and a dust collector (not shown) in which the foreign substances suctioned from the surface cleaned are accumulated.

The cleaner main body 10 and the suction brush 20 may be directly connected without using a separate hose. A handle 11 is provided on an upper side of the cleaner main body 10 for a user to operate. A switch 12 may be provided at the handle 11 to control the motor.

Therefore, a user grabs the handle 11 and moves the cleaner main body 10 after the motor is started by the switch 12, and thereby dust and foreign substances are suctioned in via the suction brush 20 and collected in the cleaner main body 10.

The suction brush 20 is provided to be connected to a lower end of the cleaner main body 10. The suction brush 20 includes a suction brush case 21.

A first intake port 41 may be formed at a lower surface of the suction brush case 21. A suction channel 40 is formed in the suction brush case 21 for air and foreign substances suctioned via the first intake port 41 to move. The suction channel 40 of the suction brush case 21 is connected to the cleaner main body 10.

The suction brush case 21 includes an upper case 21*a* and a lower case 21*b*. The upper case 21*a* forms an exterior of an upper side of the suction brush 20, and the lower case 21*b* forms an exterior of a lower side of the suction brush 20 under the upper case 21*a*. The cleaner main body 10 may be connected with the suction brush case 21 via a suction connection portion 22. The suction connection portion 22 includes a first suction connection portion 22*a* formed at the upper case 21*a* and a second suction connection portion 22*b* formed at the lower case 21*b*. The first suction connection portion 22*a* and the second suction connection portion 22*b* are formed to be connected in shapes corresponding to each other. The first suction connection portion 22*a* and the second suction connection portion 22*b* may be connected to the suction channel 40 of the suction brush 20.

The lower case 21*b* is provided at the lower end of the cleaner main body 10. A wheel installation portion 23 in which a wheel (not shown) is installed may be provided to move the cleaner main body 10 at the lower case 21*b*.

In addition, the lower case 21*b* may include a driving part installation portion 25 in which a driving part 30 for driving a rotation of a drum brush 140, which is to be described below, is installed and a connection member installation portion 272 provided for installing a connection member 200.

Meanwhile, the suction brush 20 may be provided with the drum brush 140 to easily perform cleaning for a carpet or the like.

The drum brush 140 may be rotatably provided in a drum brush case 100. The drum brush case 100 may be provided to be detachable in a forward direction (a first direction F) from the suction brush case 21.

Figure 4:
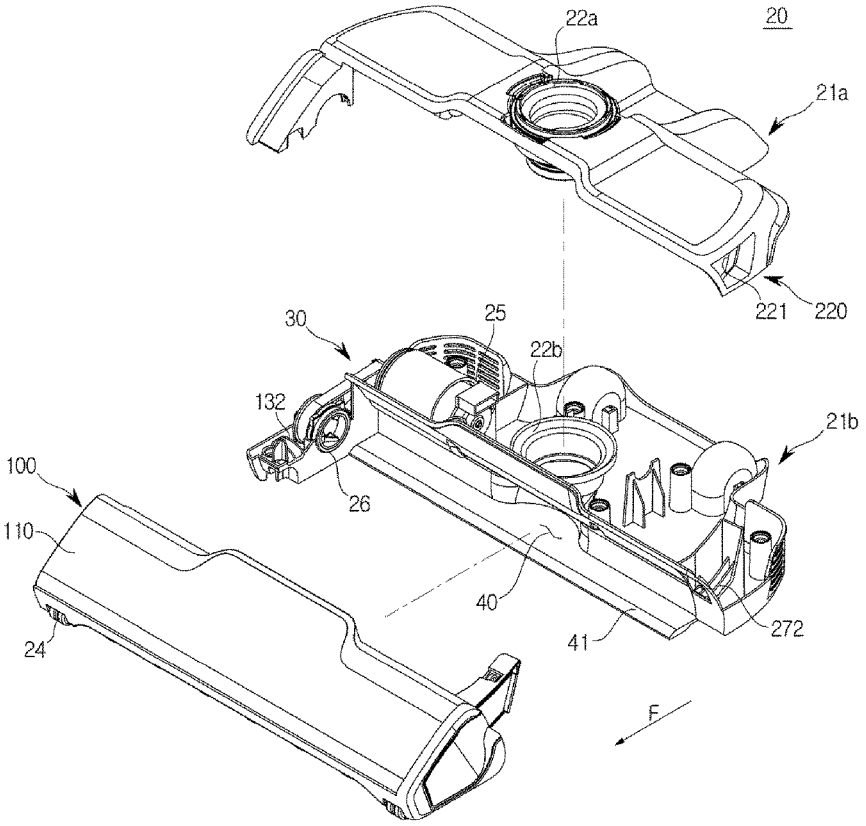
FIG. 4 is an exploded perspective view illustrating a suction brush and a drum brush case according to one embodiment of the present disclosure.
Figure 5:
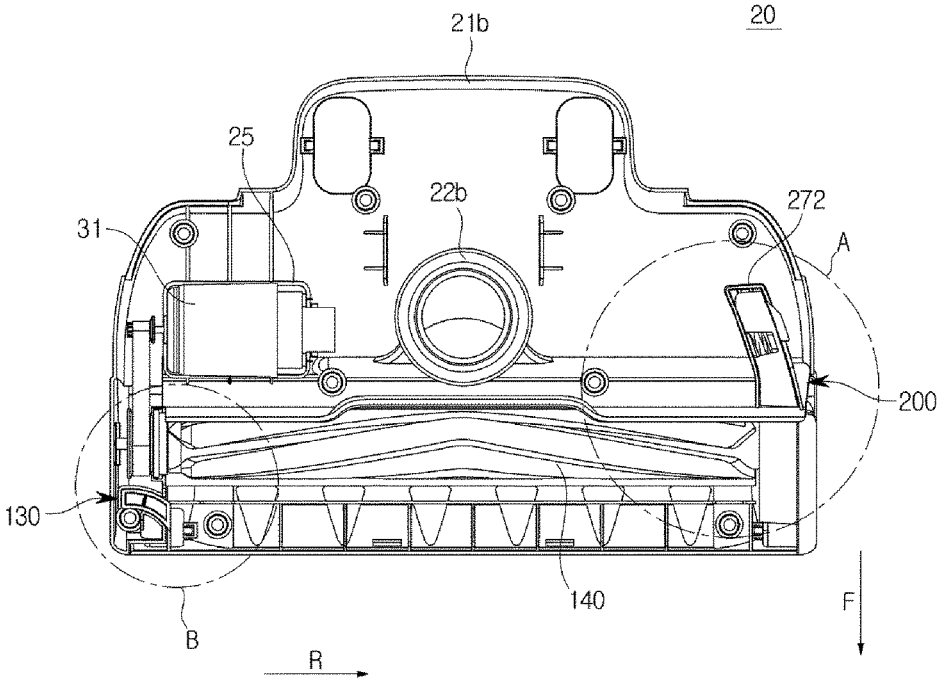
FIG. 5 is a view illustrating a suction brush and a drum brush case according to one embodiment of the present disclosure.
Figure 6:
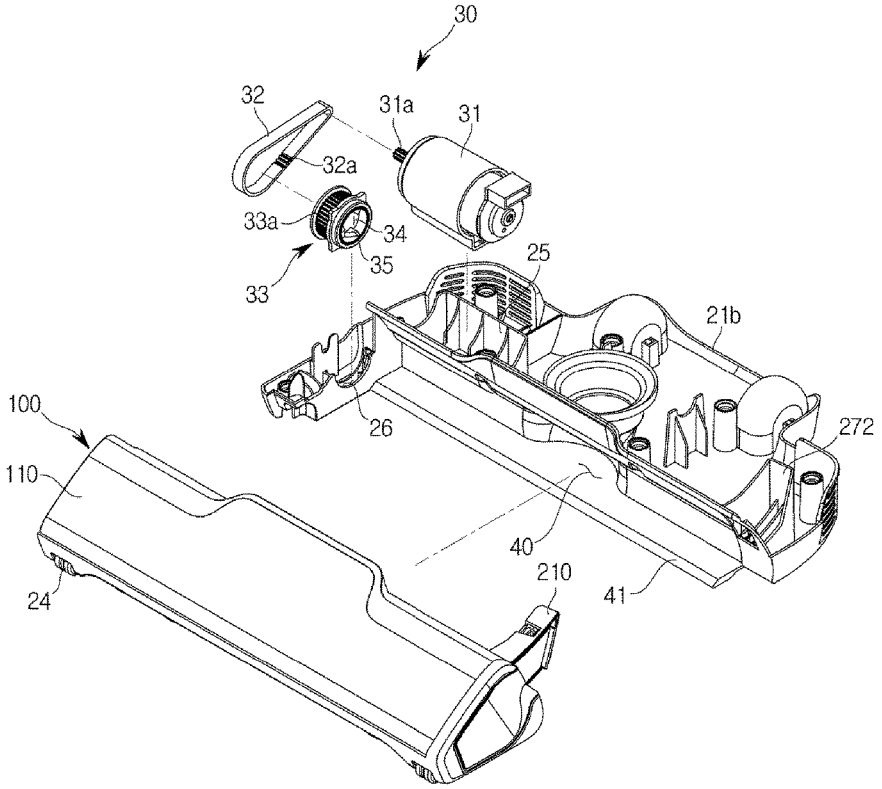
FIG. 6 is an exploded perspective view illustrating a driving part of a suction brush according to one embodiment of the present disclosure.
Figure 7:
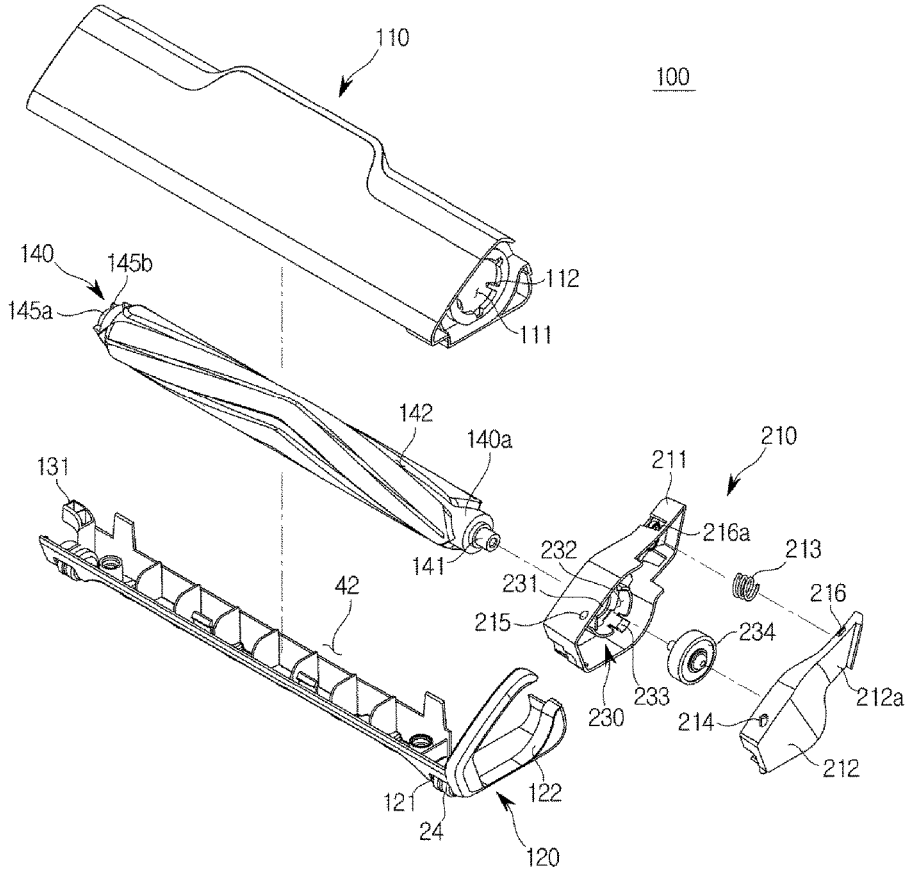
FIG. 7 is an exploded perspective view illustrating a suction brush case according to one embodiment of the present disclosure.

FIG. 4 is an exploded perspective view illustrating the suction brush and the drum brush case according to one embodiment of the present disclosure, FIG. 5 is a view illustrating the suction brush and the drum brush case according to one embodiment of the present disclosure, FIG. 6 is an exploded perspective view illustrating the driving part of the suction brush according to one embodiment of the present disclosure, and FIG. 7 is an exploded perspective view illustrating the suction brush case according to one embodiment of the present disclosure.

As illustrated in FIGS. 4 to 7, the drum brush 140 is rotatably installed in the drum brush case 100 in a lateral direction.

The drum brush case 100 includes a case cover 110 provided with an accommodation portion for accommodating the drum brush 140 and a case frame 120 to which the case cover 110 is coupled.

A second intake port 42 connected with the first intake port 41 of the suction brush 20 is formed at a lower surface of the drum brush case 100, and the second intake port 42 is connected with the suction channel 40 of the suction brush 20. The second intake port 42 may be formed at a position corresponding to the first intake port 41.

Dust and foreign substances on a surface to be cleaned which are suctioned via the first intake port 41 of the suction brush 20 and the second intake port 42 of the drum brush case 100 are collected to the cleaner main body 10 via the suction channel 40.

Meanwhile, the drum brush 140 may be provided with a rotating drum 140*a* in a cylindrical shape and a brush (not shown) installed on an outer circumferential surface of the rotating drum 140*a* in a spiral or parallel shape. The brush is exposed to the outside of the second intake port 42 and serves a role of brushing foreign substances including dust or the like on a surface to be cleaned by a rotation of the drum brush 140 and guiding the foreign substances into the cleaner main body 10 via the first intake port 41 and the second intake port 42.

The drum brush 140 may include a remover groove 142 formed in an outer circumferential surface of the rotating drum 140*a*. At least one remover groove 142 may be formed in the outer circumferential surface of the rotating drum 140*a* in a spiral or parallel shape.

The drum brush case 100 may include the case frame 120 and the case cover 110 coupled to the case frame 120 to form an accommodation space in which the drum brush 140 is accommodated. Although an example in which the case frame 120 and the case cover 110 are individually provided and are coupled to each other is illustrated in the embodiment of the present disclosure, the spirit of the present disclosure is not limited thereto. For example, the case frame and the case cover may be integrally formed.

The case frame 120 may be formed in a length corresponding to a front portion of the suction brush 20. The case frame 120 may be formed to be coupled to the front portion of the suction brush 20. An auxiliary wheel installation portion 121 may be formed in the front of the case frame 120 for an auxiliary wheel 24 to be installed. The auxiliary wheel 24 may help the suction brush 20 move together with the wheel installed at the wheel installation portion 23 of the suction brush 20.

The case cover 110 may be formed to cover an upper surface of the case frame 120. A drum brush installation portion 111 is formed at one side of the case cover 110 for the drum brush 140 to be installed thereat. The drum brush installation portion 111 may include a hole in a circular form so that the drum brush 140 may pass through an end of one side of the case cover 110.

Meanwhile, one side of the drum brush 140 may be installed at the drum brush installation portion 111 of the case cover 110, and the other side may be installed at a drum brush installation hole 26 formed at the lower case 21*b* of the suction brush 20.

The case cover 110 may include the drum brush installation portion 111 formed so that the drum brush 140 is detachable and a remover protrusion 112 formed to be spaced in a circumferential direction of the drum brush installation portion 111. At least one remover protrusion 112 may be formed at the drum brush installation portion 111. The remover protrusion 112 may be formed in a size corresponding to the remover groove 142 of the drum brush 140 for being inserted therein. The remover protrusion 112 may guide a movement of the drum brush 140 when the drum brush 140 is separated from the case cover 110.

The remover protrusion 112 may be obliquely formed in a radially inward direction of a drum brush installation hole 26. The remover protrusion 112 may be obliquely formed in a direction opposite to a separation direction (a second direction R) of the drum brush 140. Foreign substances including hair and the like wound around an outer circumferential surface of the drum brush 140 are caught by the remover protrusion 112 and collected at the remover protrusion 112 due to the slope of the remover protrusion 112.

Therefore, during separating the drum brush 140 from the case cover 110, the drum brush 140 may be separated via the drum brush installation portion 111 while the remover protrusion 112 is guided by the remover groove 142 of the case cover 110.

Here, the foreign substances including hair and the like wound around or stuck on the outer circumferential surface of the drum brush 140 may be clumped by the remover protrusion 112 of the case cover 110.

The drum brush installation portion 111 is provided to be connected with the driving part installation portion 25 of the suction brush 20. The driving part 30 provided to rotate the drum brush 140 is installed at the drum brush installation portion 111 and the driving part installation portion 25.

The driving part 30 may include a motor 31, a belt 32 which transfers driving force of the motor 31 to the drum brush 140, and a pulley 33 which connects the belt 32 and the drum brush 140.

Here, the motor 31 and the belt 32 may be installed at the driving part installation portion 25, and the pulley 33 for connecting the drum brush 140 with the belt 32 may be installed at a drum brush installation hole 26.

The motor 31 may include a motor shaft 31*a*. One side of the belt 32 is coupled to the motor shaft 31*a* of the motor 31. A sawtooth 32*a* may be formed on an inner circumferential surface of the belt 32.

A pulley sawtooth 33*a* in a shape corresponding to the sawtooth 32*a* may be formed at an outer circumferential surface of the pulley 33 which is coupled to the belt 32.

Accordingly, the belt 32 which connects the motor shaft 31*a* of the motor 31 and the pulley sawtooth 33*a* of the pulley 33 may transfer the driving force of the motor 31 to the pulley 33 to rotate the pulley 33.

Meanwhile, a drum brush accommodation groove 34 to which the drum brush 140 is coupled is formed at the pulley 33 so that the pulley 33 is connected with the drum brush 140. The drum brush accommodation groove 34 is formed in a shape corresponding to a shape of one end of the drum brush 140. A rotation protrusion 35 for rotating the drum brush 140 is formed at the drum brush accommodation groove 34. The rotation protrusion 35 is formed to correspond to an insertion groove 145*a* of the drum brush 140.

The insertion groove 145*a* and an insertion protrusion 145*b* are formed at one side of the drum brush 140. The rotation protrusion 35 of the drum brush accommodation groove 34 may be coupled to the insertion groove 145*a*, and the insertion protrusion 145*b* may be coupled to the drum brush accommodation groove 34. Rotation of the pulley 33 may be transferred to the drum brush 140 due to the insertion groove 145*a*, the insertion protrusion 145*b* of the drum brush 140, the drum brush accommodation groove 34, and the rotation protrusion 35 of the pulley 33.

A rotating shaft 141 is formed at the other side of the drum brush 140. The rotating shaft 141 may be rotatably connected to a bearing 234 which is to be described below.

The connection member installation portion 272 for installing the connection member 200 is provided at the case frame 120 of the drum brush case 100. The connection member installation portion 272 is integrally formed at one end portion of the case frame 120. The connection member installation portion 272 extends bent at one end portion of the case frame 120.

The connection member 200 is provided to detachably connect the drum brush case 100 and the suction brush 20.

The connection member 200 may include a first connection portion 210 provided at the drum brush case 100 and a second connection portion 220 provided at the suction brush 20 so that the first connection portion 210 is detachably coupled thereto.

The first connection portion 210 may include a connection bracket 211 which forms an exterior and a button member 212 which is elastically supported by the connection bracket 211.

The first connection portion 210 may include an elastic member 213 provided to support between the connection bracket 211 and the button member 212 elastically. Although an example in which the button member 212 is elastically supported by the connection bracket 211 due to the elastic member 213 is illustrated in the embodiment of the present disclosure, the spirit of the present disclosure is not limited thereto. For example, the button member 212 may include a leaf spring.

The connection bracket 211 is formed in a shape corresponding to a shape of the connection member installation portion 272 of the drum brush case 100. The connection bracket 211 may include a support portion 230 by which the drum brush 140 is rotatably supported.

The support portion 230 may include a support hole 231 by which the drum brush 140 is rotatably supported, a support protrusion 233 formed to be spaced in a circumferential direction, and the bearing 234 provided between the support hole 231 and the support protrusion 233 so that the drum brush 140 is rotatably connected.

The support portion 230 may include a bearing accommodation portion 232 in which the bearing 234 is accommodated. The bearing accommodation portion 232 may be formed between the support hole 231 and the support protrusion 233. The bearing 234 accommodated in the bearing accommodation portion 232 is connected to the rotating shaft 141 of the drum brush 140 via the support hole 231.

The support protrusion 233 is formed to protrude toward the center of a circle at an outer side of the support hole 231 to prevent separation of the bearing 234. At least one support protrusion 233 may be disposed with a regular gap in a circumferential direction.

The button member 212 is installed to be elastically supported at the connection bracket 211. The button member 212 is formed in a board shape. The button member 212 is formed in a shape corresponding to the connection bracket 211. The button member 212 may be disposed at outer side of the bearing 234. The elastic member 213 is provided between the connection bracket 211 and the button member 212. The elastic member 213 generates elastic force between the connection bracket 211 and the button member 212 and may return back to an original position, when pressed and moved by a user.

The button member 212 in the board shape further includes a pressing surface 212*a* formed to be easily pressed by a user.

The button member 212 includes a hinge shaft 214 formed to protrude therefrom in order to support rotation of the button member 212. A hinge hole 215 to which the hinge shaft 214 of the button member 212 is coupled is formed at the connection bracket 211.

Therefore, when a user presses the button member 212, the button member 212 rotates about the hinge shaft 214 coupled to the hinge hole 215 of the connection bracket 211 so as to press and move the elastic member 213.

Here, the button member 212 includes a stopper 216 formed to restrict the movement thereof. A stopper groove 216*a* corresponding to the stopper 216 of the button member 212 is formed at the connection bracket 211.

When the user completes pressing, the button member 212 returns back to the original position. Here, the stopper 216 is caught by the stopper groove 216*a*, and the movement is restricted.

Meanwhile, the second connection portion 220 is provided at the suction brush 20. The second connection portion 220 may include a connection hole 221 formed at the upper case 21*a* of the suction brush 20 and a connection member installation portion 272 provided at the lower case 21*b*. The connection hole 221 and the connection member installation portion 272 are formed at corresponding positions to be connected by a coupling of the upper case 21*a* and the lower case 21*b*. The connection member installation portion 272 is formed in a recessed shape so that the first connection portion 210 is inserted therein. The first connection portion 210 inserted in the connection member installation portion 272 may be exposed to the outside of the suction brush 20 via the connection hole 221. Although the second connection portion 220 including the connection hole 221 by which a part of the upper case 21*a* is open is taken as an example and illustrated in the embodiment of the present disclosure, the spirit of the present disclosure is not limited thereto. For example, the second connection portion 220 may further include a button method.

Figure 8:
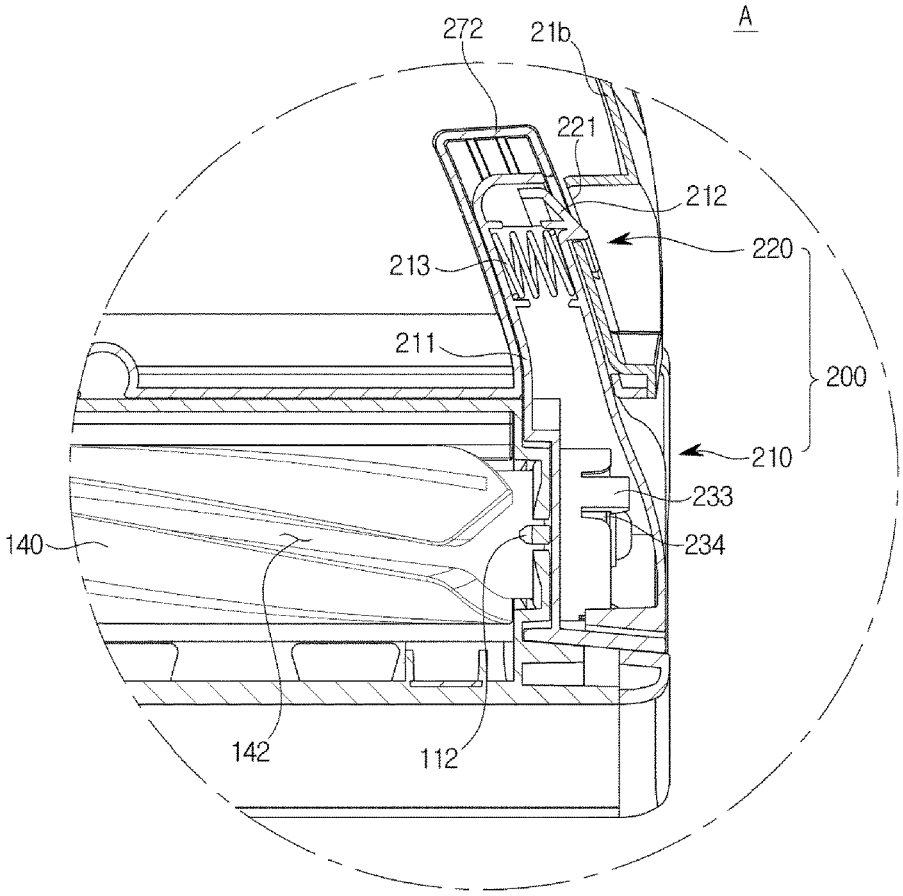
FIG. 8 is an enlarged view of region A of FIG. 5 illustrating a connection member for connecting a suction brush and a drum brush case according to one embodiment of the present disclosure.
Figure 9:
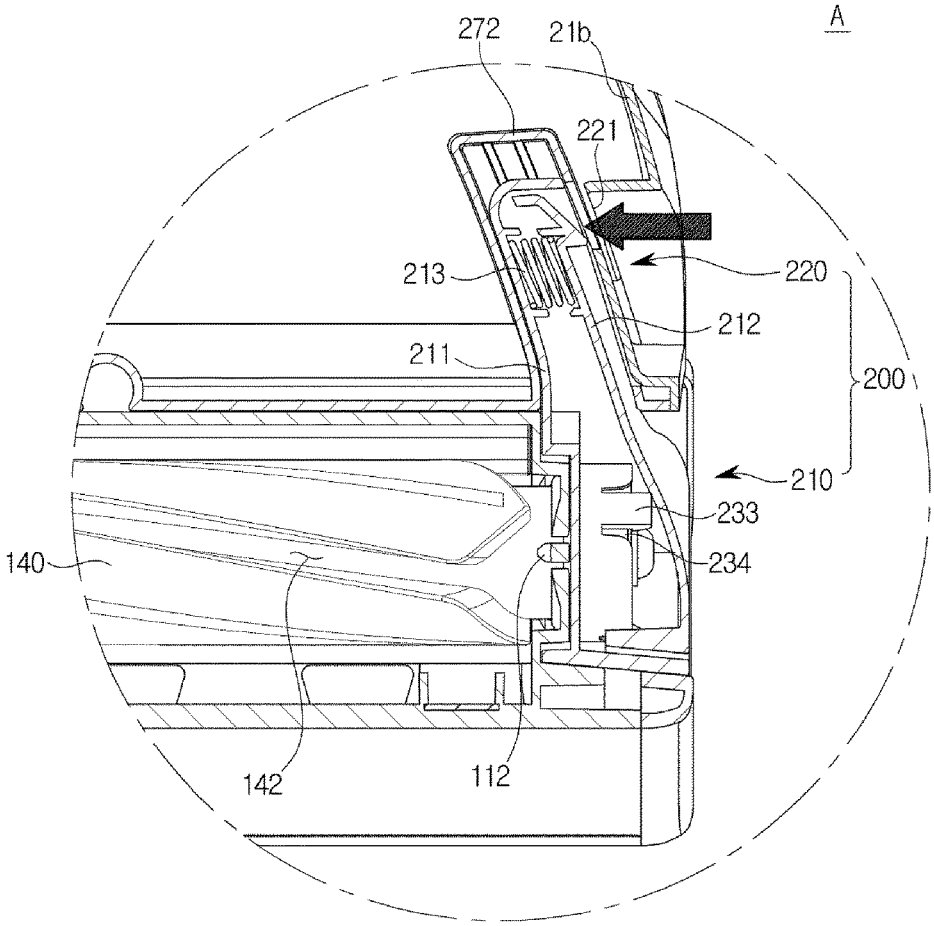
FIG. 9 is a view illustrating an operation of a connection member for separating a suction brush and a drum brush case according to one embodiment of the present disclosure.
Figure 10:
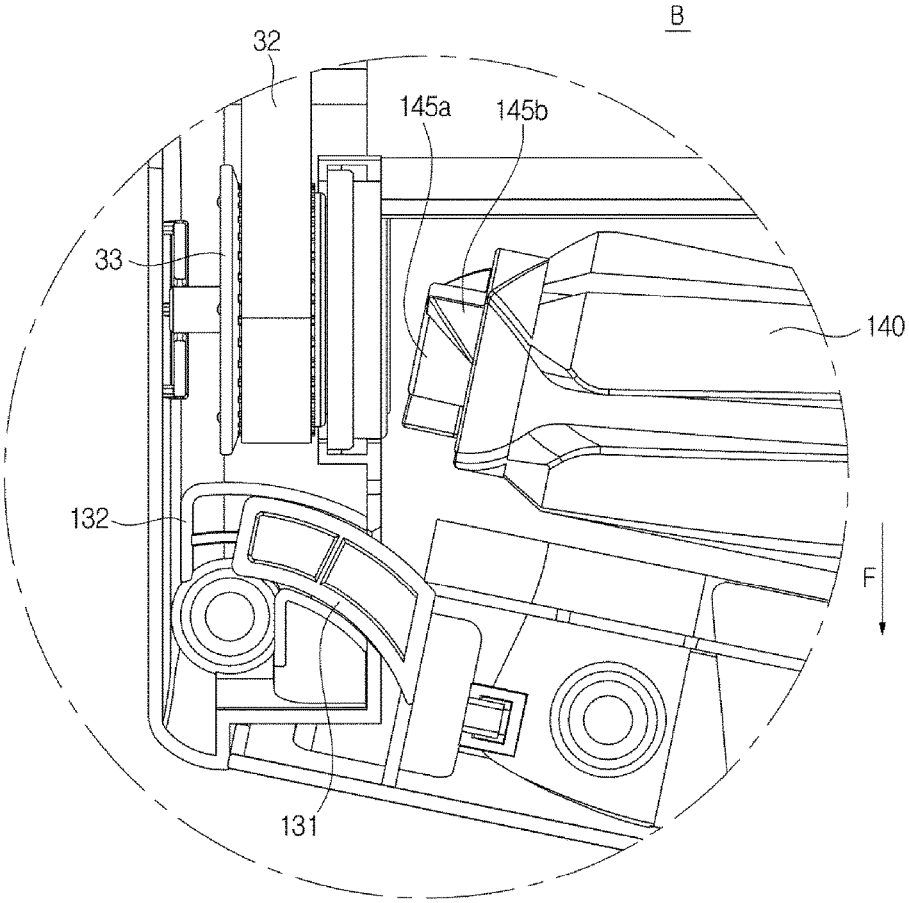
FIG. 10 is an enlarged view illustrating a guide portion which guides a movement of a drum brush case which is separated in a forward direction from a suction brush according to one embodiment of the present disclosure.

FIG. 8 is an enlarged view of region A of FIG. 5 illustrating the connection member for connecting the suction brush and the drum brush case according to one embodiment of the present disclosure, FIG. 9 is a view illustrating an operation of the connection member for separating the suction brush and the drum brush case according to one embodiment of the present disclosure, and FIG. 10 is an enlarged view illustrating a guide portion which guides a movement of the drum brush case which is separated in a forward direction from the suction brush according to one embodiment of the present disclosure.

The drum brush 140 is provided at an accommodation space formed by the case cover 110 of the drum brush case 100. The drum brush 140 is rotatably installed in the drum brush case 100. The drum brush case 100 at which the rotatable drum brush 140 is provided may be detachably installed at the suction brush 20 by the connection member 200.

The connection member 200 is coupled to the second connection portion 220 of the suction brush 20 by the first connection portion 210 formed at the drum brush case 100.

The button member 212 of the connection member 200 is exposed to the outside of the suction brush 20 by the connection hole 221 of the second connection portion 220.

When a user presses the button member 212 exposed to the outside, the button member 212 moves about the hinge shaft 214 toward the inside (arrow) of the connection bracket 211.

The button member 212 is moved by pressing the elastic member 213. When the button member 212 moves toward the inside and releases lock between the button member 212 of the first connection portion 210 and the connection hole 221 of the second connection portion 220, the drum brush case 100 is separated in a forward direction from the suction brush 20, that is, in the first direction F.

Here, a guide portion 130 is provided, which guides separation between the drum brush case 100 and the suction brush 20. The guide portion 130 may include a guide protrusion 131 provided at the drum brush case 100 and a guide groove 132 provided at the suction brush 20.

The guide protrusion 131 is provided at the case frame 120 of the drum brush case 100. The guide protrusion 131 is formed to have a predetermined curvature. The guide protrusion 131 may stably guide a movement of the drum brush case 100 which is moved in the first direction F by the connection member 200. The guide groove 132 is provided at one side of the suction brush 20. The guide groove 132 may be disposed in front of the drum brush installation hole 26 of the suction brush 20.

By a coupling of the guide protrusion 131 and the guide groove 132, the drum brush 140 may be guided to the drum brush accommodation groove 34 and stably coupled to the pulley 33. Although an example in which the guide protrusion is formed at the drum brush case and the guide groove is provided at the suction brush is illustrated in the embodiment of the present disclosure, the spirit of the present disclosure is not limited thereto. For example, the guide protrusion may be provided at the suction brush, and the guide groove may be provided at the drum brush case.

Meanwhile, the button member 212 returns back to the original position when the separation of the drum brush case 100 is completed. Here, the stopper 216 of the button member 212 is caught by the stopper groove 216*a* and supports and prevents the button member 212 from being deviated to the outside of the connection bracket 211.

Figure 11:
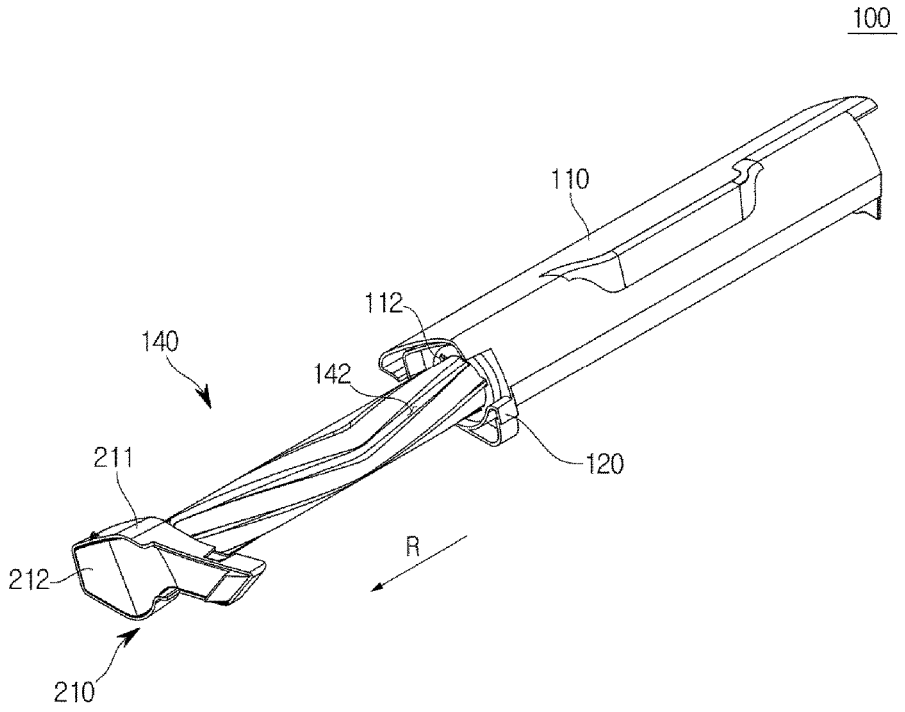
FIG. 11 is a view illustrating a drum brush separated from a drum brush case according to one embodiment of the present disclosure.
Figure 12:
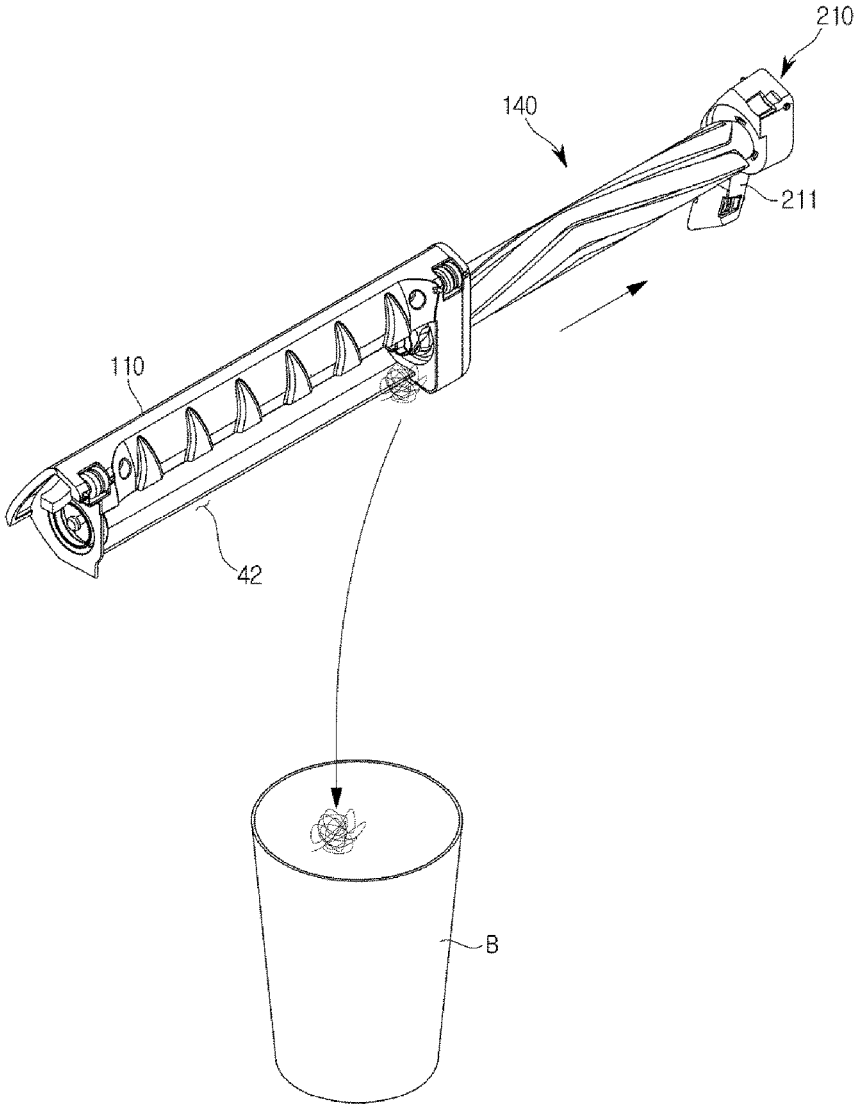
FIG. 12 is a view illustrating a state in which hair and foreign substances are cleaned when a drum brush is separated from a drum brush case according to one embodiment of the present disclosure.

FIG. 11 is a view illustrating the drum brush separated from the drum brush case according to one embodiment of the present disclosure, and FIG. 12 is a view illustrating a state in which hair and foreign substances are cleaned when the drum brush is separated from the drum brush case according to one embodiment of the present disclosure.

The drum brush 140 installed in the drum brush case 100 and separated from the suction brush 20 may be separated from the drum brush case 100 by pulling the first connection portion 210 of the connection member 200 in the second direction R of the drum brush case 100.

The first connection portion 210 of the connection member 200 is coupled to the drum brush 140 in order to be grabbed by a user. The rotating shaft 141 of the drum brush 140 is coupled to the bearing 234 installed in the connection bracket 211, and thereby the connection bracket 211 of the first connection portion 210 is provided to be separated together with the drum brush.

Meanwhile, the drum brush 140 separated from the drum brush case 100 may be moved in an outward direction from the drum brush case 100 while the remover groove 142 of the drum brush 140 is guided by the remover protrusion 112 of the drum brush case 100.

Here, foreign substances including hair or the like jammed or wound around the remover groove 142 of the drum brush 140 is caught and collected by the remover protrusion 112 formed at the drum brush installation portion 111 of the drum brush case 100.

The foreign substances including hair and the like are collected to the drum brush case 100 by the remover protrusion 112, and the drum brush 140 may be separated from the drum brush case 100 in a clean state.

Meanwhile, by separating the drum brush 140 from the drum brush case 100 at around a garbage can B, the foreign substances including hair and the like may be thrown into the garbage can B right away.

Accordingly, user convenience can be enhanced because the drum brush 140 can be cleaned without moving the cleaner main body 10 by separating the drum brush case 100 in a forward direction from the suction brush 20 and only with an operation of pulling out the first connection portion 210 connected to the drum brush 140.

As is apparent from the above description, hair and foreign substances wound around the drum brush can be easily removed.

In addition, user convenience can be enhanced because the drum brush case is separable.

Some particular embodiments have been illustrated and described above. However, without being limited to the embodiments described as above, those skilled in the art will readily appreciate that many modifications are possible in embodiments without departing from the spirit and the essential features of the disclosure described in the claims below.

What is claimed is:

1. A vacuum cleaner comprising:

a cleaner main body;

a suction brush assembly to be connected to the cleaner main body to clean a surface to be cleaned by suction force, the suction brush assembly including:

a suction brush case including a suction channel and a second connection portion, a drum brush case provided to be detachable from the suction brush case, the drum brush case including a drum installation hole to receive a drum brush and being configured to form an intake port connected to the suction channel, a first connection portion including a connection bracket to rotatably support the drum brush and a button member elastically supported by the connection bracket, and the button member of the first connection portion including an elastic bias to be engaged with the second connection portion to secure the drum brush case and the first connection portion to the suction brush case, the button member of the first connection portion being deflected against the elastic bias to be released from the second connection portion to detach the drum brush case and the first connection portion from the suction brush case, wherein the drum brush is received in a drum brush installation hole in the drum brush case, the drum brush installation hole includes at least one remover protrusion projecting radially inward, wherein while the first connection portion and the drum brush are detached from the drum brush case by withdrawing the drum brush from the drum installation hole, the at least one remover protrusion is configured to remove foreign substances wound around the drum brush during the withdrawing of the drum brush from the drum installation hole.

2. The vacuum cleaner of claim 1, wherein the drum brush is rotatably provided in the drum brush case.

3. The vacuum cleaner of claim 2, wherein the drum brush case includes:

a case frame, and a case cover coupled to the case frame, the case cover configured to form a space in which the drum brush is accommodated.

4. The vacuum cleaner of claim 3, wherein the case cover includes:

a drum brush installation portion formed so that the drum brush is detachable, and wherein the at least one remover protrusion is formed to be spaced in a circumferential direction of the drum brush installation portion.

5. The vacuum cleaner of claim 4, wherein the at least one remover protrusion is formed to protrude radially inward of the drum brush installation portion.

6. The vacuum cleaner of claim 4, wherein the at least one remover protrusion is slanted radially inward of the drum brush installation portion.

7. The vacuum cleaner of claim 2, wherein the drum brush case includes a guide portion which guides decoupling from or coupling to the suction brush case.

8. The vacuum cleaner of claim 7, wherein the guide portion includes:

a guide protrusion formed at the drum brush case; and a guide groove formed at the suction brush so that the guide protrusion is inserted therein.

9. The vacuum cleaner of claim 7, wherein the guide portion has a curvature.

10. The vacuum cleaner of claim 2, wherein the suction brush includes a driving part provided to rotate the drum brush.

11. The vacuum cleaner of claim 1, further comprising: an elastic member which provides a support between the connection bracket and the button member elastically.

12. The vacuum cleaner of claim 1, wherein the second connection portion includes one of a hole and a slit to which the button member is coupled.

13. The vacuum cleaner of claim 1, wherein the first connection portion includes a support portion comprising:

a support hole in which the drum brush is rotatably supported, at least one support protrusion formed to be spaced in a circumferential direction of the support hole, and a bearing provided between the support hole and the at least one support protrusion so that the drum brush is rotatably connected.

14. The vacuum cleaner of claim 1, wherein the connection bracket is bent from and coupled to an end of one side of the drum brush for a user to grab.

15. A vacuum cleaner comprising:

a cleaner main body;

a suction brush assembly to be connected to the cleaner main body to suction dust on a surface to be cleaned, the suction brush assembly including:

a suction brush case including a second connection portion, a drum brush case detachably coupled to a front of the suction brush case, the drum brush case including a drum installation hole to receive a drum brush which is rotatably provided therein;

a first connection portion including a connection bracket to rotatably support the drum brush and a button member elastically supported by the connection bracket, the connection bracket being bent from and coupled to an end of one side of the drum brush for a user to grab, a guide portion having a curvature to guide a movement of the drum brush case;

the button member of the first connection portion including an elastic bias to be engaged with the second connection portion to secure the drum brush case and the first connection portion to the suction brush case, the button member of the first connection portion being deflected against the elastic bias to be released from the second connection portion to detach the drum brush case and the first connection portion from the suction brush case, wherein the drum brush is received in a drum brush installation hole in the drum brush case, the drum brush installation hole includes at least one remover protrusion projecting radially inward, and wherein while the first connection portion and the drum brush are detached from the drum brush case by withdrawing the drum brush from the drum installation hole, the at least one remover protrusion is configured to remove substance wound around the drum brush during the withdrawing of the drum brush from the drum installation hole.

* * * * *